US007249623B2

(12) United States Patent
Chhun et al.

(10) Patent No.: US 7,249,623 B2
(45) Date of Patent: Jul. 31, 2007

(54) BRACING BRACKET FOR ARCHED WINDOW BLINDS

(76) Inventors: Justin S. Chhun, No.215, Jeou Ju 1st Road, Sun Ming Dist., Kaohsiung City (TW); Li-Ming Cheng, No.215, Jeou Ju 1st Road, Sun Ming Dist., Kaohsiung City (TW)

( * ) Notice: Subject to any disclaimer, the term of this patent is extended or adjusted under 35 U.S.C. 154(b) by 259 days.

(21) Appl. No.: 10/975,462

(22) Filed: Oct. 29, 2004

(65) Prior Publication Data

US 2006/0090859 A1 May 4, 2006

(51) Int. Cl.
*E06B 3/48* (2006.01)

(52) U.S. Cl. ..... 160/84.07; 160/134

(58) Field of Classification Search ..... 160/84.07, 160/134, 38, 330, 348, 178.2 R
See application file for complete search history.

(56) References Cited

U.S. PATENT DOCUMENTS 581,410 A * 4/1897 Biehn ..... 49/60
1,057,310 A * 3/1913 White ..... 49/60
1,609,877 A * 12/1926 Kendall ..... 160/84.07
5,002,112 A 3/1991 Schnebly et al.
5,010,939 A 4/1991 King
5,794,680 A * 8/1998 Xue ..... 160/84.07
6,145,569 A * 11/2000 Shaw et al. ..... 160/84.07
6,865,817 B2 * 3/2005 Militello et al. ..... 33/194
7,000,669 B2 * 2/2006 Hsu ..... 160/84.07

* cited by examiner

*Primary Examiner*—David Purol
(74) *Attorney, Agent, or Firm*—Birch, Stewart, Kolasch & Birch, LLP

(57) ABSTRACT

An improved bracing bracket for arched window blinds includes a protrusive seat which has a wedge notch on the top rim to couple with a mating plank so that the coupled protrusive seat and the plank may serve as the installation basis. A left material and a right material may be bonded to two sides of the plank. The protrusive seat has a mark in the center of the front side and the rear side to align with a window sill to bond the bracing bracket to the window sill without skewing to facilitate fast installation.

8 Claims, 9 Drawing Sheets

BRACING BRACKET FOR ARCHED WINDOW BLINDS

FIELD OF THE INVENTION

The present invention relates to an improved bracing bracket for arched window blinds and particularly to a bracing bracket for arched window blinds that is easy to install rapidly.

BACKGROUND OF THE INVENTION

In the general residential houses or buildings, many people like to set up arched window blinds on the upper side of the windows to enhance ornamental effect. Most people also set up window coverings on the inner side of the windows and arched transoms to block sunshine and protect privacy. To set up window coverings on a window and an arched window, a bracing bracket has to be installed first. FIG. 1 (U.S. Pat. No. 6,145,569) illustrates an arched window blind which has an one-way extendable blind B mounted on one side of a window sill A and a bracing bracket C to hold the blind B. The bracket C includes a base C1 and arched tracks C2 and C3 to guide extension of the blind B. Although it can hold the blind B, the bracket C is difficult to install. It also is more costly.

FIG. 2 shows U.S. Pat. No. 5,010,939 which is a blind for arched windows. It includes a bracing bracket D containing a center axle D1 to couple with two sets of blinds E and F on the periphery. While it is relatively easy to install on the window sill of an arched window, the coupling locations in the center of the blinds B and F are remote from the axle D1. The extended blinds E and F do not have a coupling basis. As a result, coupling of the blinds E and F cannot be done smoothly.

FIG. 3 shows another conventional bracket structure disclosed in U.S. Pat. No. 5,002,112. The bracing bracket G has an arched seat G1 and a center plank G2 and two side planks G3 and G4. The side planks G3 and G4 are respectively coupled with an inset plank G5 and G6. A window shade H has a hollow material H1 to couple on the center plank G2. Then two sides H2 and H3 of the window shade H are bonded to the side planks G3 and G4 to brace the window shade H on the bracing bracket G. Installation involves assembly and bonding of the window shade, and is more complicated.

In view of the aforesaid disadvantages occurred to the conventional bracing brackets such as more expensive and difficult to install, applicant discovers that most arched window blinds are seldom opened once set up. Hence to install a window blind that may be opened one-way or two-way, or closed is a waste of construction and cost. Moreover, most conventional arched window blinds cannot be trimmed to fit different types of arched windows. There are still rooms for improvement.

SUMMARY OF THE INVENTION

Therefore the primary object of the invention is to provide an improved bracing bracket for arched window blinds that has a protrusive seat and a plank. The protrusive seat has an arched top rim with a wedge notch formed thereon, and a mark formed respectively in the center of a front end and a rear end thereof. The plank has a wedge rib on one end mating and engageable with the wedge notch to form a bracing bracket to serve as the bonding basis of a left material and a right material.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
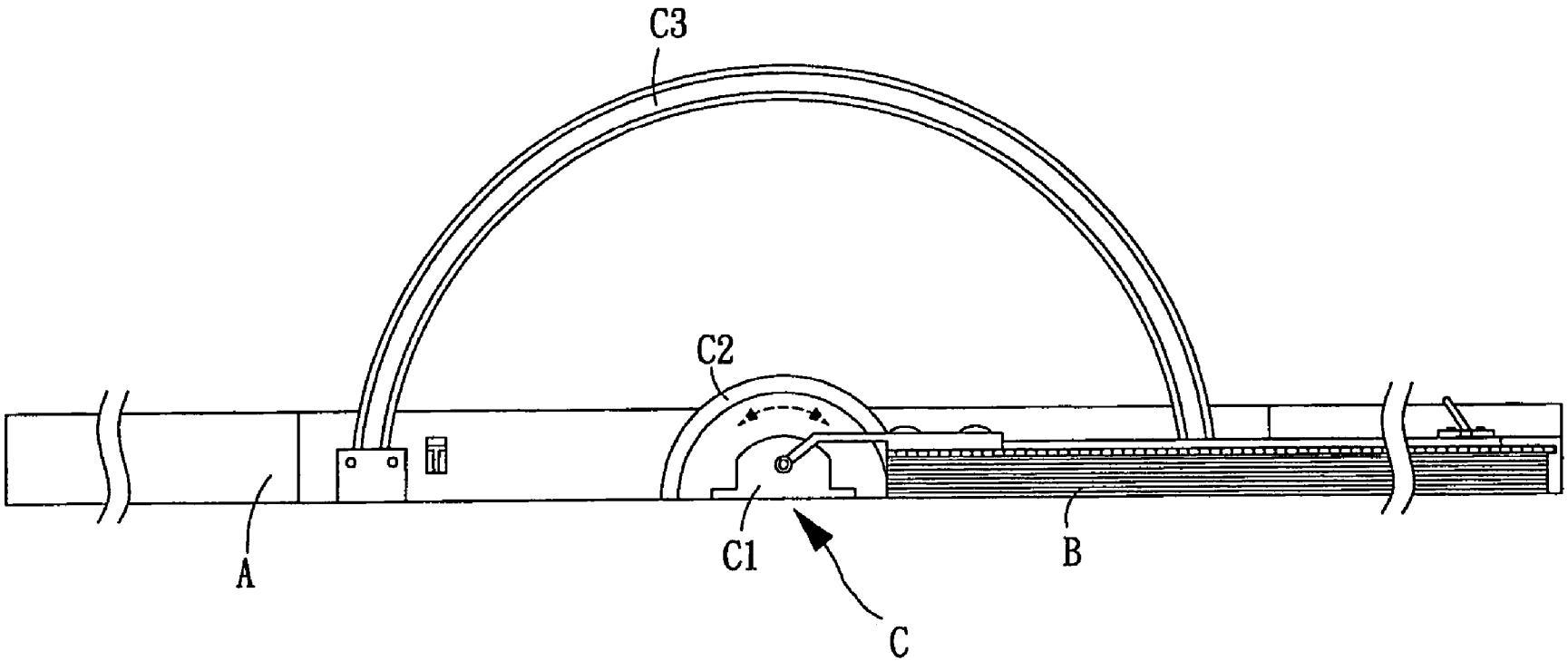
Fig. 1 PRIOR ART
FIG. 1 is a front view of the arched window blind structure disclosed in U.S. Pat. No. 6,145,569.
Figure 2:
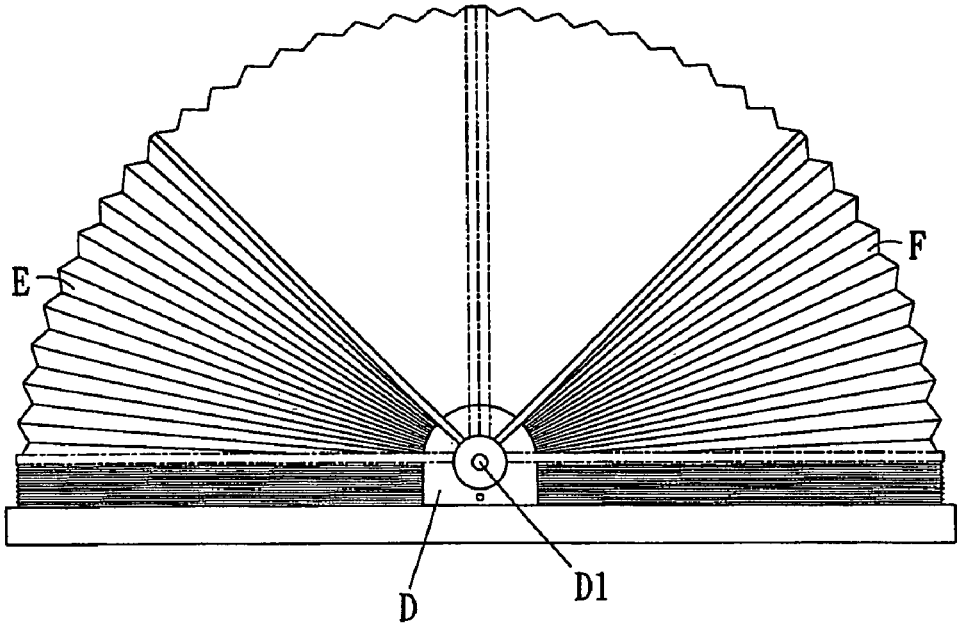
Fig. 2 PRIOR ART
FIG. 2 is a front view of the arched window blind disclosed in U.S. Pat. No. 5,010,939.
Figure 3:
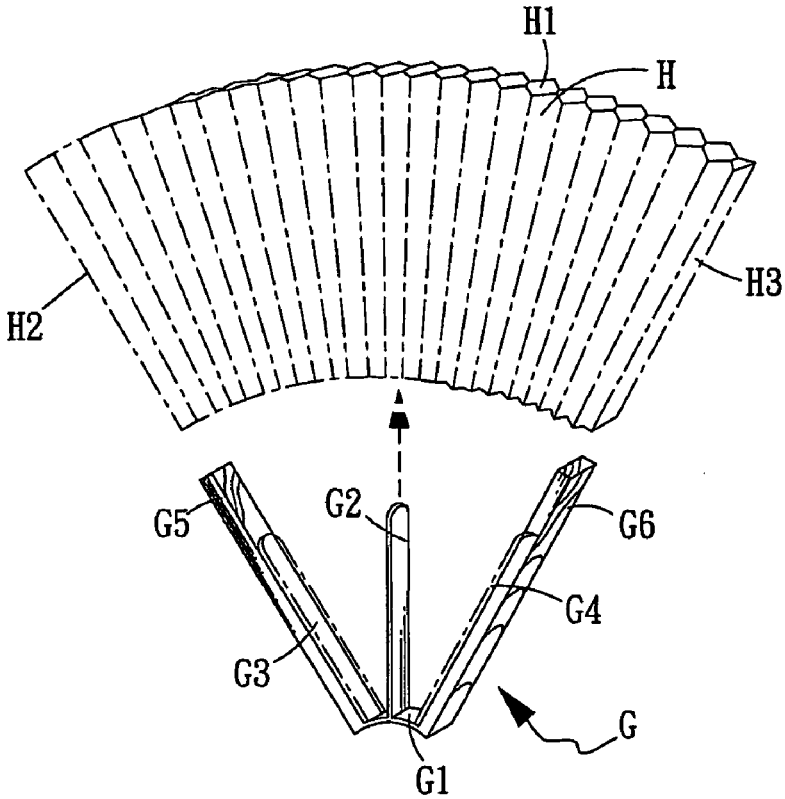
Fig. 3 PRIOR ART
FIG. 3 is a front view of the arched window blind structure disclosed in U.S. Pat. No. 5,002,112.
Figure 4:
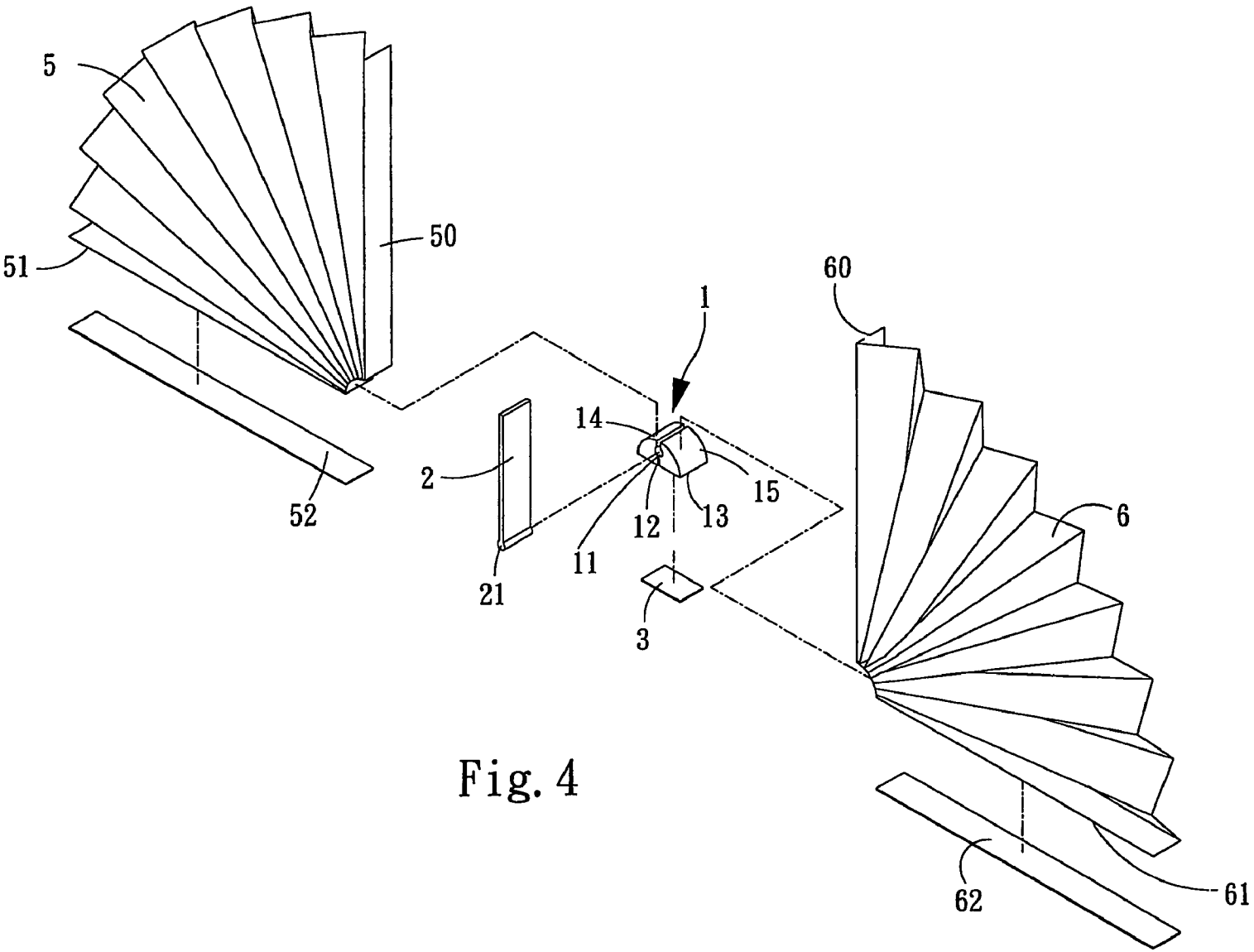
FIG. 4 is an exploded view of the present invention.
Figure 5A:
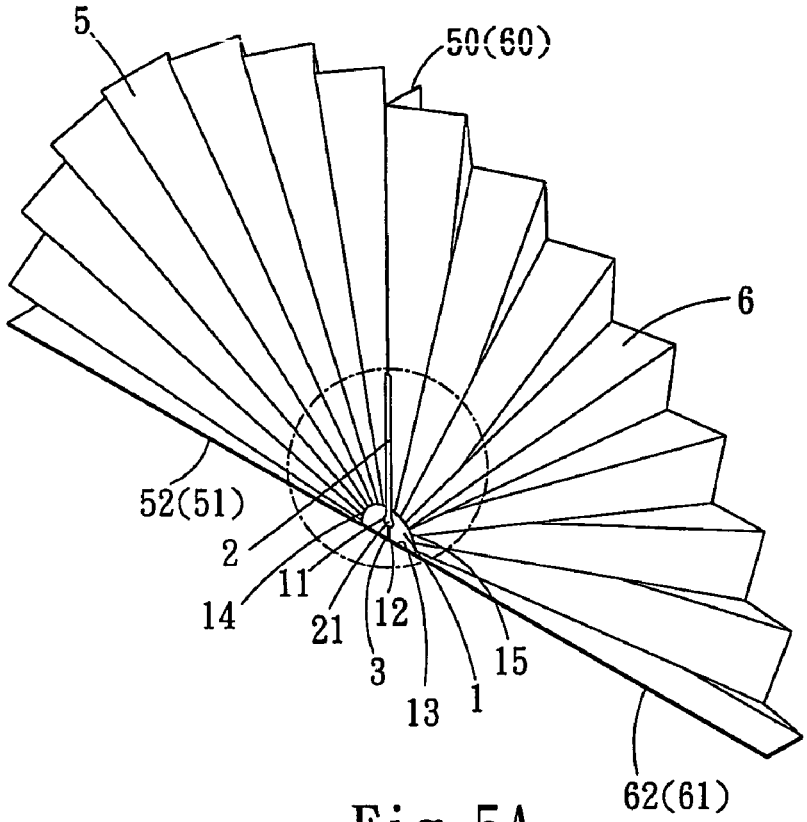
FIG. 5A is a perspective view of the present invention in use.
Figure 5B:
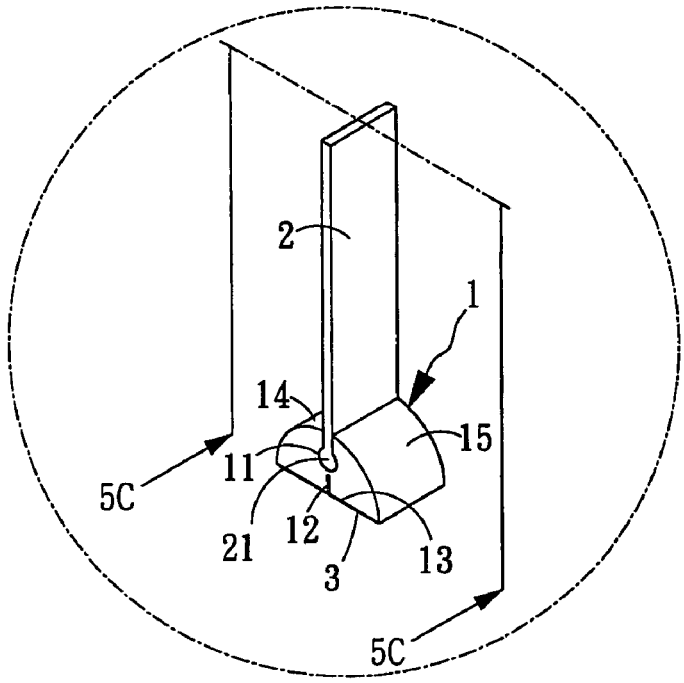
FIG. 5B is a perspective view of the bracing bracket of the present invention.
Figure 5C:
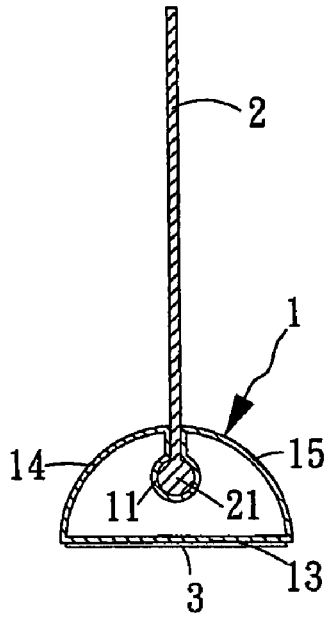
FIG. 5C is a cross section taken on line 5C-5C in FIG. 5B.

Please referring to FIGS. 4 through 5C, the improved bracing bracket for arched window blinds according to the present invention includes a protrusive seat 1 and a plank 2. The protrusive seat 1 has an arched and convex top rim with a wedge notch 11 formed thereon to couple with the plank 2, a mark 12 formed respectively in the center of a front side and a rear side. The protrusive seat 1 has a bottom side 13 bonding to a double-sided adhesive 3, and two arched surfaces 14 and 15 on two sides to couple with a left material 5 and a right material 6. The plank 2 has a wedge rib 21 on one end mating the wedge notch 11.

Figure 6A:
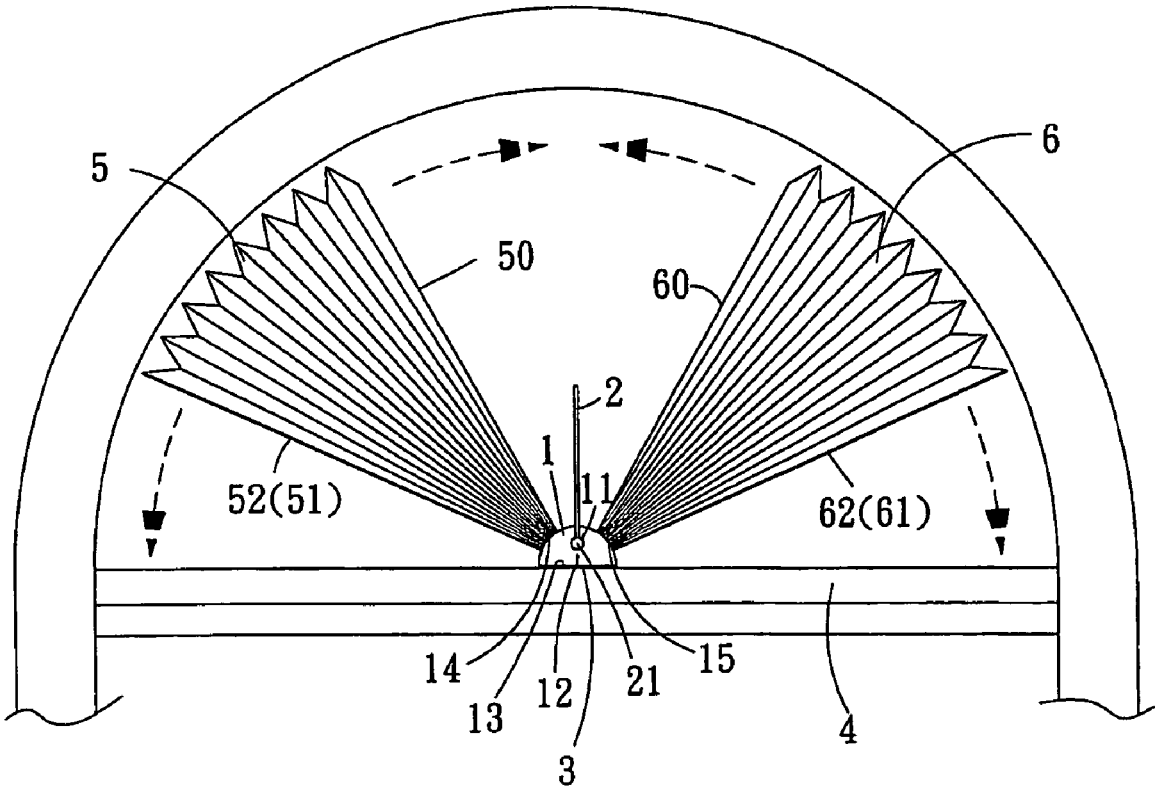
FIG. 6A is a front view of the present invention assembled.
Figure 6B:
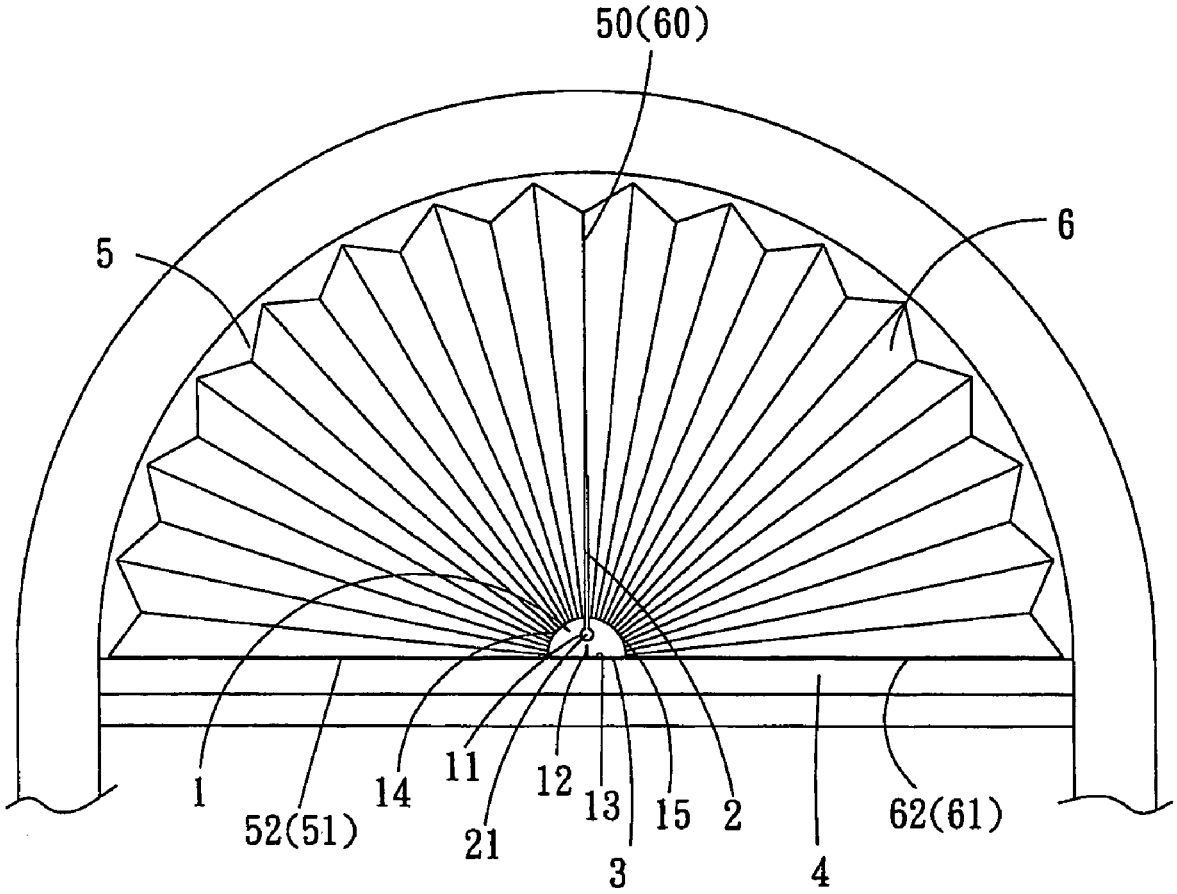
FIG. 6B is another front view of the present invention assembled.

For assembly, affix the double-sided adhesive 3 on the bottom side 13 of the protrusive seat 1, and align the marks 12 on the front and rear ends of the protrusive seat 1 with the center of a window sill 4 and mount the protrusive seat 1 onto the window sill 4 for anchoring; couple the wedge rib 21 in the wedge notch 11 to form the bracing bracket (as shown in FIGS. 5B and 5C). Thereby two arched surfaces 14 and 15 on two sides of the protrusive seat 1 may be coupled with the left material 5 and the right material 6, and two neighboring edges 50 and 60 of the material 5 and 6 may be bonded to the basis side of the plank 2. The left and right material 5 and 6 also have respectively an outer edge 51 and 61 coupling with a double-side adhesive 52 and 62 to bond to the window sill 4 to install the left and right material 5 and 6 as shown in FIGS. 6A and 6B.

Figure 7:
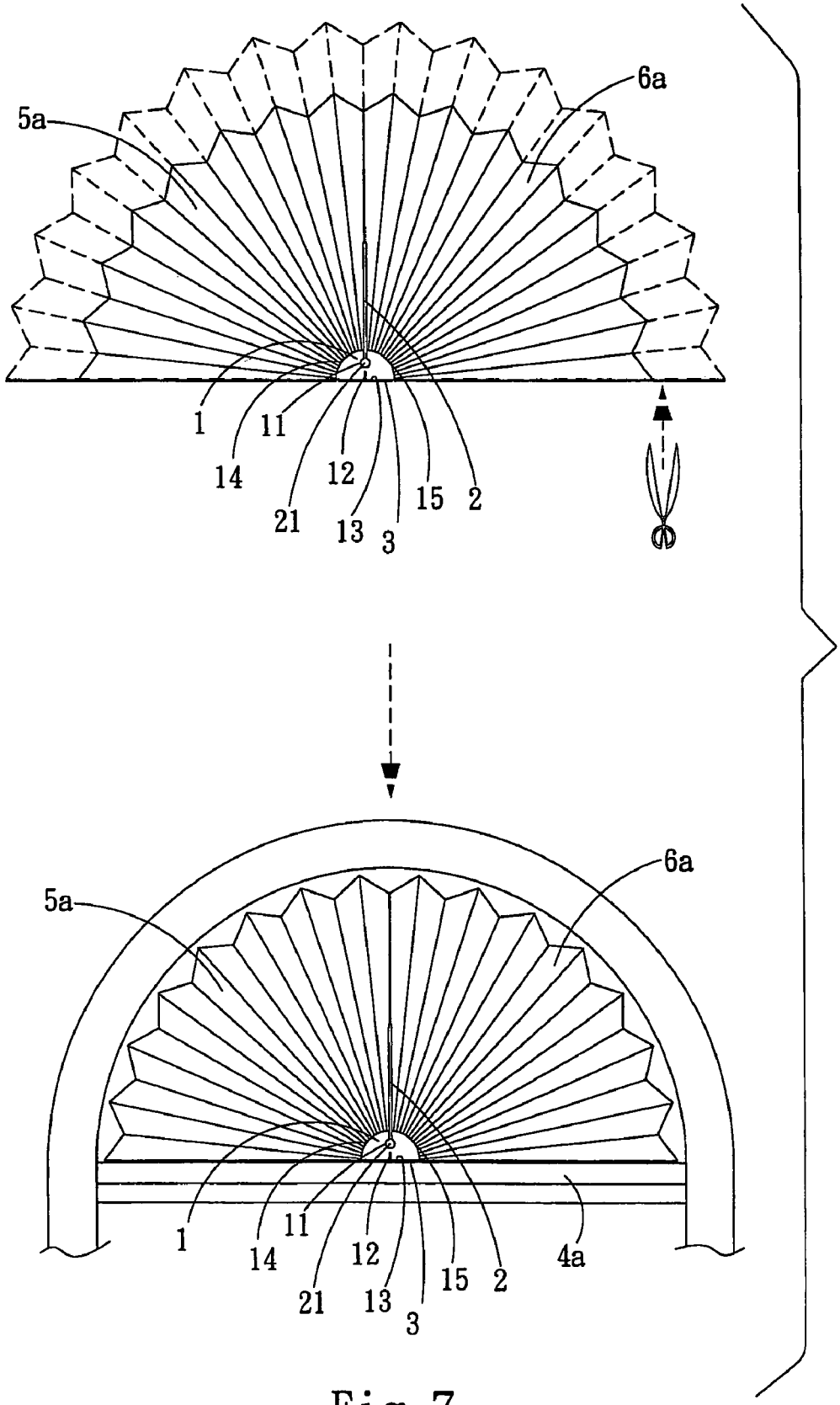
FIG. 7 is a schematic view of the window blind trimmed to a smaller size according to the present invention.

Referring to FIG. 7. The left and right material 5*a* and 6*a* of the invention to the plank 2, may be trimmed according to the size of the arched window and the specification of the window sill 4*a* so that the two neighboring edges of the material 5*a* and 6*a* may be bonded together, then be positioned and bonded to the window sill 4*a* as desired and become a different specification of the left and right material 5*a* and 6*a*.

Figure 8:
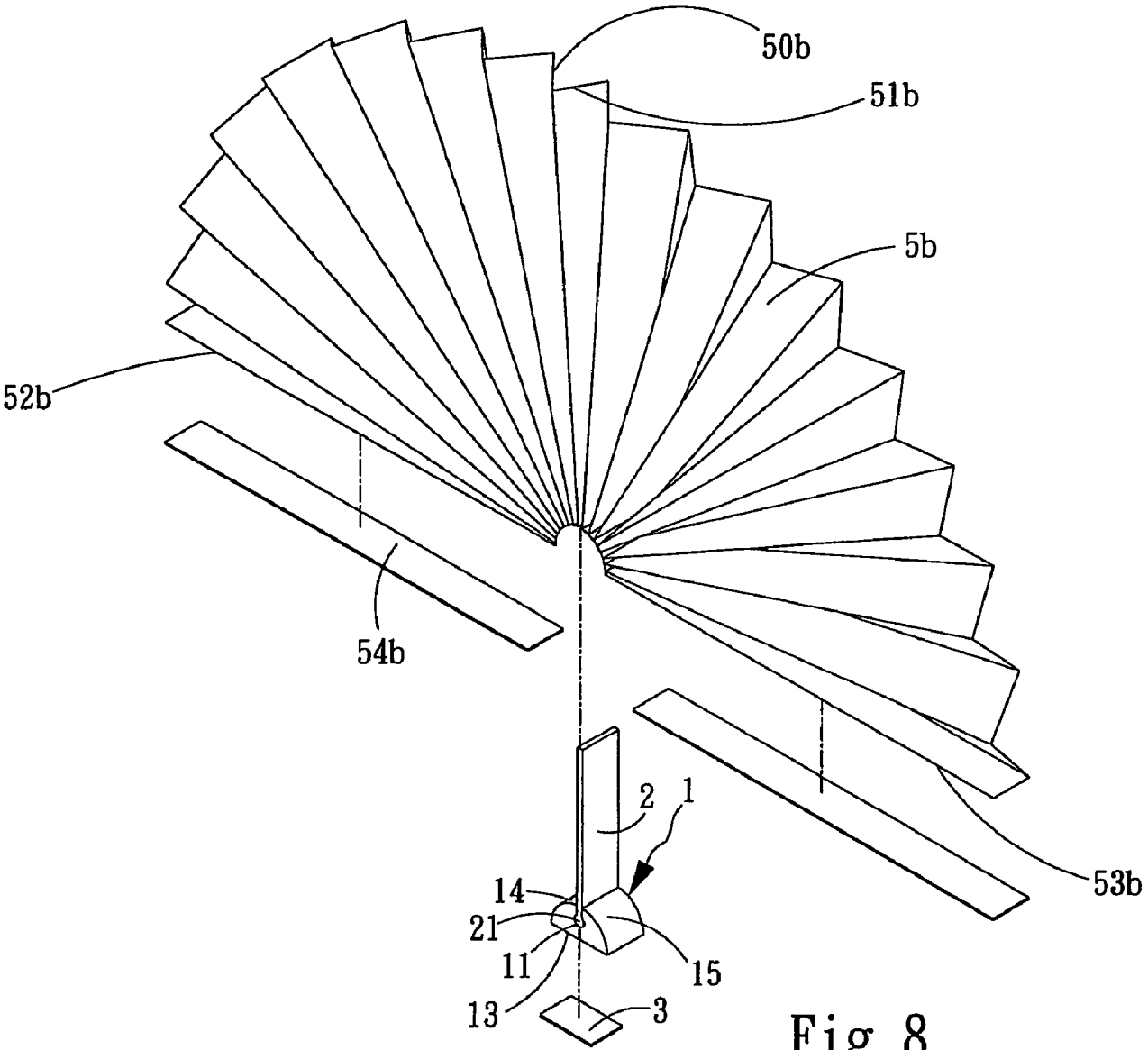
FIG. 8 is an exploded view of another embodiment of the invention.
Figure 9:
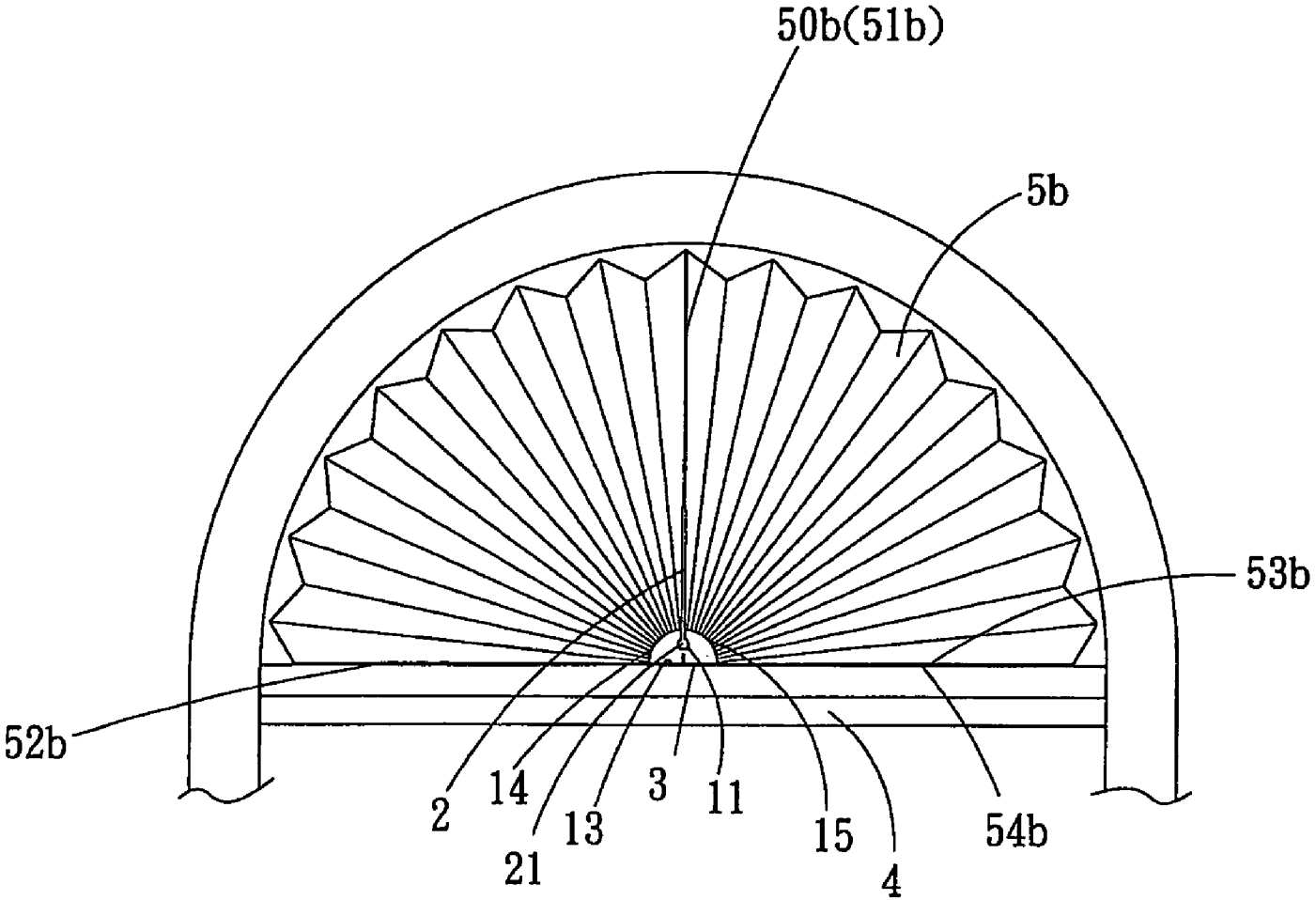
FIG. 9 is a front view of another embodiment of the invention.

Refer to FIG. 8 for another embodiment of the invention for bonding the plank 2 on the protrusive seat 1 and a material 5*b*. The two sides of the plank 2 are bonded respectively to two neighboring pleated sides 50*b* and 51*b* of the material 5*b*, and two lateral sides 52*b* and 53*b* of the material 5*b* have respectively a double-sided adhesive 54*b* bonded thereon to adhere to the window sill 4*b* for installing the material 5*b* (also referring to FIG. 9).

What is claimed is:

1. A bracing bracket and blind for an arched window comprising a plank to bond neighboring edges of a left material and a right material, the left material and the right material having respectively an outer edge to be bonded to a window sill through a double-sided adhesive, the left material and the right material having a top rim and a bottom rim, the bracing bracket includes a protrusive seat and the plank, the protrusive seat having a wedge notch on the top rim thereof, the plank having a wedge rib mating and engageable with the wedge notch for coupling the plank on the protrusive seat, the bottom rims of the left and right material being proximate to the protrusive seat and the top rims of the left and right material being out of contact with the bracket and being free-standing.

2. The bracing bracket and blind for an arched window of claim 1, wherein the top rim of the protrusive seat is formed in a convex arch.

3. The bracing bracket and blind for an arched window of claim 1, wherein the protrusive seat has a mark in a center of a front side and a rear side thereof to align with a center of a window sill for mounting the protrusive seat on a desired location.

4. The bracing bracket and blind for an arched window of claim 1, wherein the neighboring edges of the left material and the right material are coupled to the plank on the protrusive seat.

5. The bracing bracket and blind for an arched window of claim 4, wherein the plank is bonded to two neighboring pleated sides of a single material.

6. The bracing bracket and blind for an arched window of claim 1, wherein the top rim of the left material and the right material are unsupported except for the bracket and any stiffness within the left and right material.

7. The bracing bracket and blind for an arched window of claim 1, wherein the left and right material are pleated and without openings therein.

8. The bracing bracket and blind for an arched window of claim 1, wherein the left and right material are fixed after installation.

* * * * *